United States Patent [19]

Ohya et al.

[11] Patent Number: 4,773,148

[45] Date of Patent: Sep. 27, 1988

[54] METHOD OF AND APPARATUS FOR REMOVING TYING BAND

[75] Inventors: Kunihiko Ohya, Kasukabe; Tohru Honma, Iwatsuki; Sohitirou Katsura, Nagoya, all of Japan

[73] Assignees: Hokkai Can Co., Ltd.; Kirin Brewery Co., Ltd., both of Tokyo, Japan

[21] Appl. No.: 33,470

[22] Filed: Apr. 2, 1987

[30] Foreign Application Priority Data

Apr. 3, 1986 [JP] Japan ..... 61-75437

[51] Int. Cl.[4] ..... B23P 19/02

[52] U.S. Cl. ..... 29/426.4; 29/56.5; 29/564.3; 83/149; 83/156; 83/909; 83/924

[58] Field of Search ..... 29/426.4, 564.3, 56.5; 83/909, 924, 156, 149

[56] References Cited

U.S. PATENT DOCUMENTS

| | | | |
|---|---|---|---|
| 3,513,522 | 5/1970 | Thomson | 29/56.5 X |
| 3,521,347 | 7/1970 | Bentley | 29/426.2 |
| 3,557,591 | 1/1971 | Lind | 72/130 |
| 3,750,504 | 8/1973 | Sidler | 83/16 |
| 4,095,078 | 6/1978 | Waenerlund et al. | 219/68 |
| 4,205,419 | 6/1980 | Aoshima | 29/56.5 |
| 4,328,609 | 5/1982 | Born | 29/564.3 |
| 4,348,801 | 9/1982 | Dumont et al. | 29/564.3 |
| 4,387,493 | 6/1983 | Nakaie | 29/56.5 |
| 4,437,223 | 3/1984 | Petros | 29/564.3 |
| 4,660,818 | 4/1987 | Conner et al. | 29/564.3 X |
| 4,718,157 | 1/1988 | Keyzers et al. | 29/426.4 |

FOREIGN PATENT DOCUMENTS

| | | |
|---|---|---|
| 54160 | 9/1986 | Australia . |
| 0004923 | 10/1979 | European Pat. Off. . |
| 0142846 | 5/1985 | European Pat. Off. . |
| 195471 | 9/1986 | European Pat. Off. . |
| 168777 | 5/1974 | Netherlands . |
| 7900847 | 9/1979 | Netherlands . |
| 8500606 | 10/1986 | Netherlands . |

*Primary Examiner*—Frank T. Yost

*Attorney, Agent, or Firm*—Birch, Stewart, Kolasch & Birch

[57] ABSTRACT

A portion of an endless tying band around a package is displaced from the package thus defining a space between the portion of the tying band and the package. Then, a guide plate is inserted into the space, and the tying band is pressed by the guide roll against the guide plate to grip the tying band between the guide plate and the guide roll. The tying band which is gripped between the guide plate and the guide roll is then severed by a cutter blade. The guide roll is located to deliver an end of the severed tying band for thereby removing the severed tying band from the package.

9 Claims, 6 Drawing Sheets

METHOD OF AND APPARATUS FOR REMOVING TYING BAND

BACKGROUND OF THE INVENTION 1. Field of the Invention:

The present invention relates to a method of and an apparatus for removing a tying band or string from a package composed of articles supported on plates stacked as layers. 2. Description of Background Art Tying bands or strings for bundling a package of articles are mechanically strong because they are required to tie the articles firmly together in order to prevent the tied articles from being displaced from each other. Generally, the tying bands bundle the package securely at a plurality of positions. When unpacking the articles, it has been customary practice to remove the tying bands from the articles only by severing the tying bands. However, the conventional unpacking procedure has been laborious, and time-consuming.

SUMMARY OF THE INVENTION

In view of the aforesaid drawbacks of the conventional unpacking process, it is an object of the present invention to provide a method of and an apparatus for severing and removing tying bands or strings efficiently in a consecutive manner.

Another object of the present invention is to provide a method of and an apparatus for severing tying bands or strings on a package without damaging the package and efficiently removing the cut-off bands or strings from the package.

According to the present invention, there is provided a method of removing an endless tying band from a package, comprising the steps of displacing a portion of the tying band from the package thus defining a space between the portion of the tying band and the package, inserting a guide plate into the space, pressing the tying band against the guide plate with a guide roll to grip the tying band between the guide plate and the guide roll, severing the tying band which is gripped between the guide plate and the guide roll, and rotating the guide roll to deliver an end of the severed tying band which is gripped between the guide plate and the guide roll for thereby removing the severed tying band from the package.

According to the present invention, there is also provided an apparatus for removing an endless tying band from a package, comprising pulling means for inserting a pulling member between the tying band and the package to displace a portion of the tying band from the package thus defining a space between the portion of the tying band and the package, guide plate means for inserting a guide plate into the space, guide roll means for pressing the tying band against the guide plate with a guide roll to grip the tying band between the guide plate and the guide roll, severing means for severing the tying band near a position in which it is gripped between the guide plate and the guide roll, and guide roll rotating means for rotating the guide roll to deliver an end of the severed tying band.

The above and other objects, features and advantages of the present invention will become more apparent from the following description when taken in conjunction with the accompanying drawings in which a preferred embodiment of the present invention is shown by way of illustrative example.

DESCRIPTION OF THE PREFERRED EMBODIMENT

Figure 1:
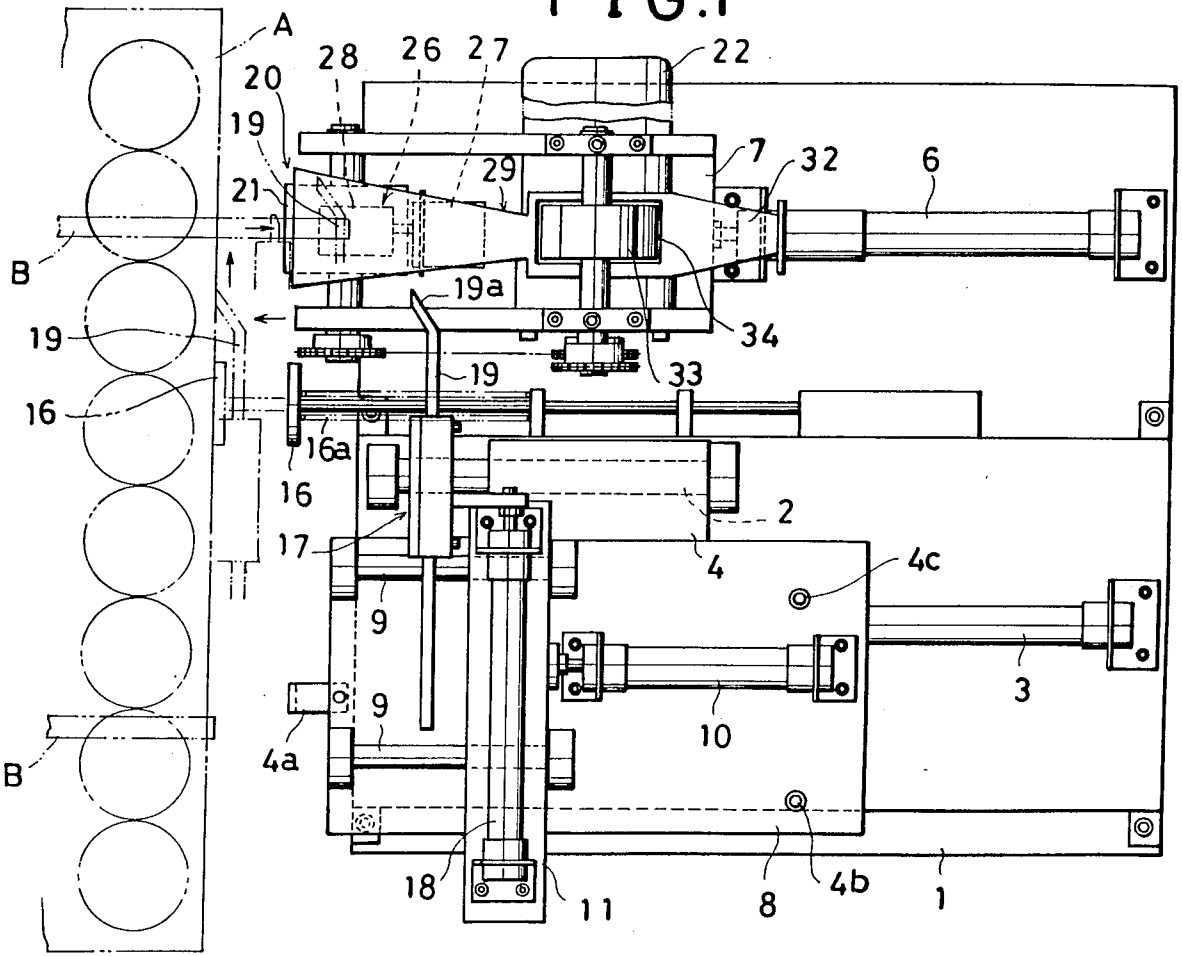
FIG. 1 is a plan view of an apparatus according to the present invention.
Figure 2:
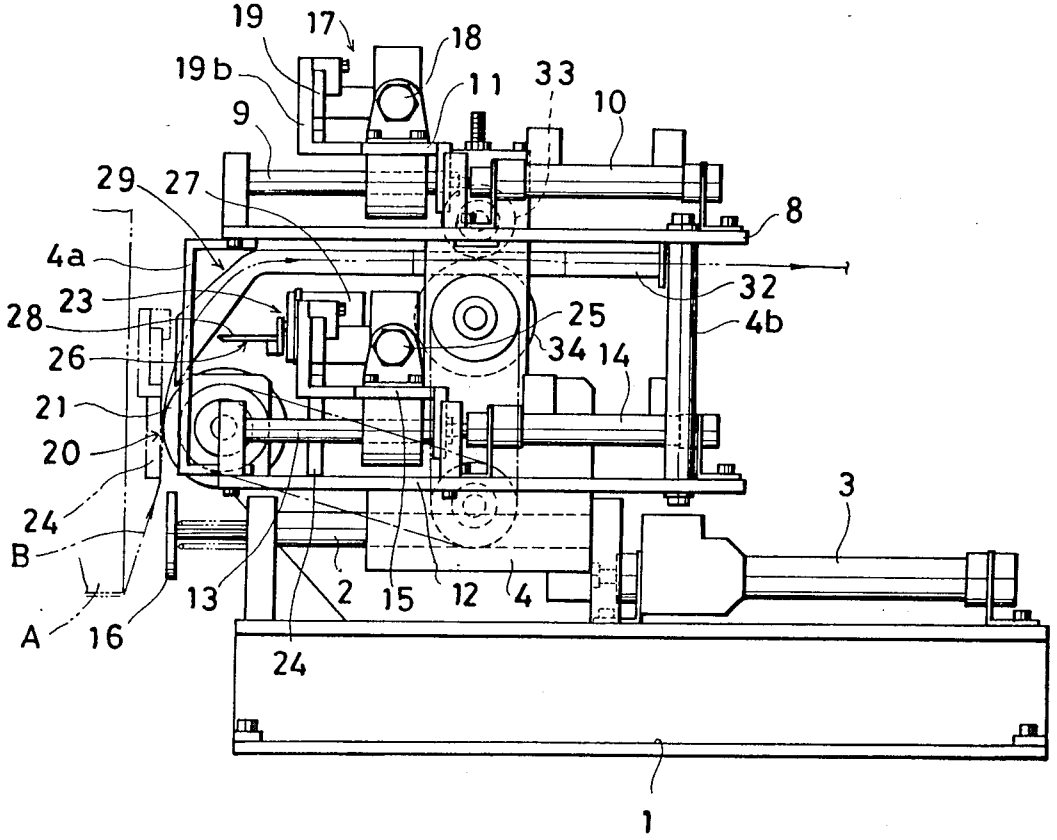
FIG. 2 is a side elevational view of the apparatus.
Figure 3:
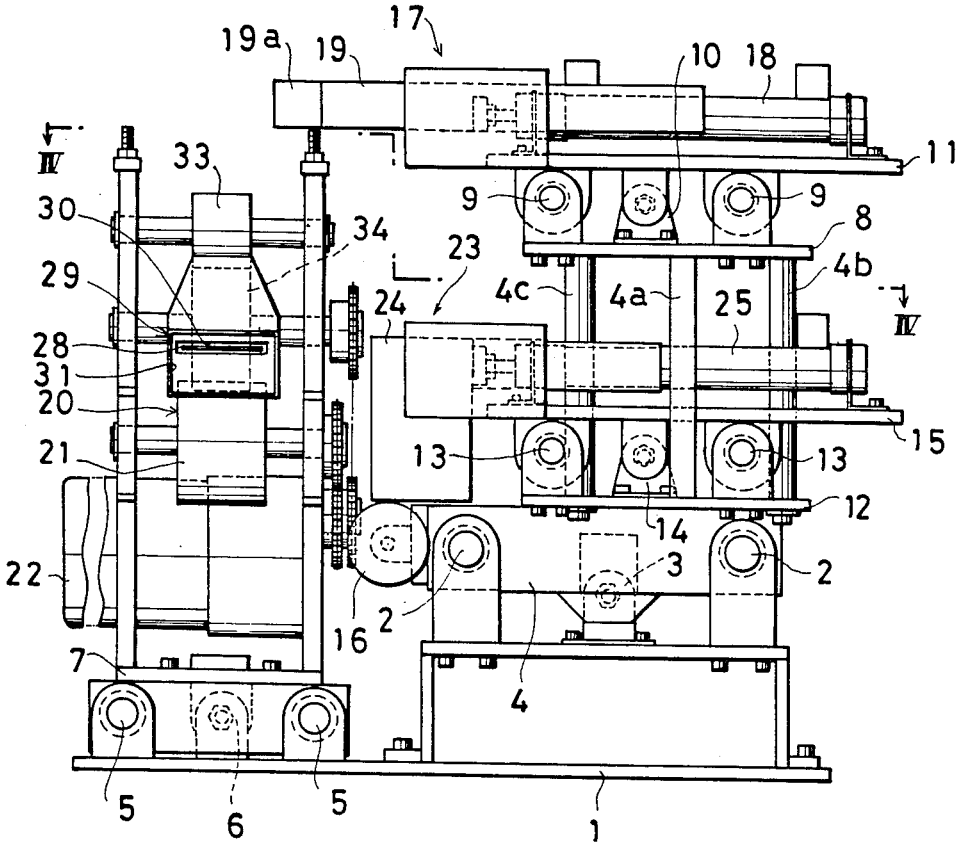
FIG. 3 is a front elevational view of the apparatus.
Figure 4:
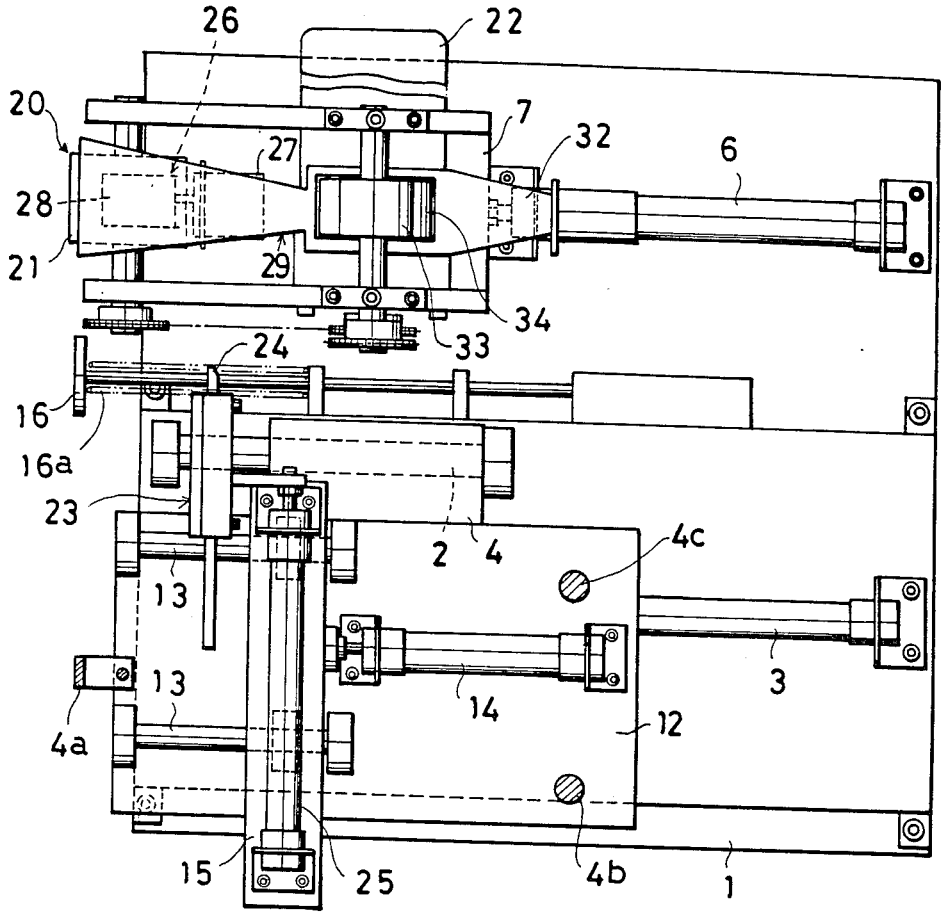
FIG. 4 is a cross-sectional view taken along line IV—IV of FIG. 3.

As shown in FIGS. 1 through 3, an apparatus for removing tying bands or strings according to the present invention includes a base 1 supporting thereon a first slide table 4 guided on a pair of first parallel guide bars 2 mounted on the base 1, the first slide table 4 being coupled to a first longitudinal fluid cylinder 3 on the base 1 for back-and-fourth movement. A second table slide table 7 (FIGS. 1 and 3) is guided on a pair of second parallel guide bars 5 mounted on the base 1 alongside of the first slide table 4 and is coupled to a second longitudinal fluid cylinder 6 on the base 1 for back-and-forth movement. An upper support plate 8 is supported on the first slide table 4 by support rods 4*a*, 4*b*, 4*c*. A third slide table 11 is guided on a pair of third parallel guide bars 9 mounted on the upper support plate 8 and is coupled to a third longitudinal fluid cylinder 10 on the support plate 8. As illustrated in FIGS. 3 and 4, a lower support plate 12 is supported between the first slide table 4 and the upper support plate 8. A fourth slide table 15 is guided on a pair of fourth parallel guide bars 13 mounted on the lower support plate 12 and is coupled to a fourth longitudinal fluid cylinder 14 for back-and-forth movement. A pusher 16 is supported by the first slide table 4 and positioned alongside therof, the pusher 16 being resiliently biased by a spring 16*a* so as to keep a package A a certain distance from the apparatus.

A pulling device 17 is mounted on the third slide table 11 and has a pulling plate 19 attached to a first transverse fluid cylinder 18 disposed on the third slide table 11 and extending perpendicularly to the direction in which the third slide table 11 is movable. As shown in FIGS. 1 and 3, the pulling plate 19 is in the form of an elongate narrow plate having a distal end 19*a* bent off the longitudinal direction thereof. The pulling plate 19 is attached to an attachment bracket 19*b* (FIG. 2) so that the amount of projection of the pulling plate 19 is adjustable with respect to the cylinder 18.

When the first slide table 4 is moved forward, i.e., toward the package A, the pulling plate 19 approaches the package A until it reaches a position spaced a certain distance from an outer surface of the package A. Then, the third slide table 11 is moved forward to bring the pulling plate 19 into engagement with the package A. Thereafter, the first transverse fluid cylinder 18 is operated to move the pulling plate 19 along the outer surface of the package A to a position (indicated by the imaginary lines in FIG. 1) above a guide roll 21 (described later), in which the pulling plate 19 is inserted between a tying band B and the package A. Then, the third slide table 11 is moved backwards to displace the tying band B away from the package A, defining a space between the package A and the tying band B.

A guide roll device 20 has the guide roll 21 which is mounted on the second slide table 7 and rotatable by a guide roll rotating unit 22.

As shown in FIGS. 2, 3, and particularly 4, a guide plate device 23 has a guide plate 24 transversely movable by a second transverse fluid cylinder 25 mounted on the fourth slide table 15 and extending perpendicularly to the direction of movement of the fourth slide plate 15. When the first slide table 4 is moved forward, the guide plate 24 is moved toward the package A until the guide plate 24 is spaced a certain distance from the package A. Then, the fourth slide table 15 is moved forward to move the guide plate 24 into engagement with the package A. Thereafter, the the second transverse fluid cylinder 25 is actuated to move the guide plate 24 along the package A into a position confronting the guide roll 21, as indicated by the imaginary lines in FIGS. 2 and 4, whereupon the guide plate 24 is inserted in the space which has been defined between the package A and the tying band B by the pulling plate 19.

Upon forward movement of the second slide table 7, the guide roll 21 is moved forward into pressing engagement with the guide plate 24 that has been moved behind the tying band B in confronting relation to the guide roll 21. The guide roll 21 and the guide plate 24 now grip the tying band B therebetween.

A cutting device 26 is disposed directly above the guide roll 21 on the second slide table 7. The cutting device 26 has a heated cutter blade 28 for cutting off the tying band B gripped between the guide roll 21 and the guide plate 24, the heated cutter blade 28 being attached to a fourth longitudinal fluid cylinder 27.

A chute 29 has a slot 30 (FIG. 3) into and out of which the heated cutter blade 28 is movable. The slot 30 has a slot 31 opening toward the position where the tying band B can be cut off. The chute 29 also has a discharge passage 32 for discharging the tying band B after it has been cut off. The chute 29 also has a pair of delivery rolls 33, 34 for forcibly discharging the severed tying band B through the discharge passage 32.

Operation of the apparatus will hereinafter be described mainly with reference to FIGS. 5(A) through 5(H).

FIGS. 5(A) through 5(D) show the apparatus as viewed from above the package A, and FIGS. 5(E) through 5(H) show the apparatus as viewed from one side of the package A.

In the illustrated embodiment, the package A is bundled by two endless tying bands or strings B extending around the package A and having portions extending vertically under tension over one side facing the apparatus.

Figure 5A:
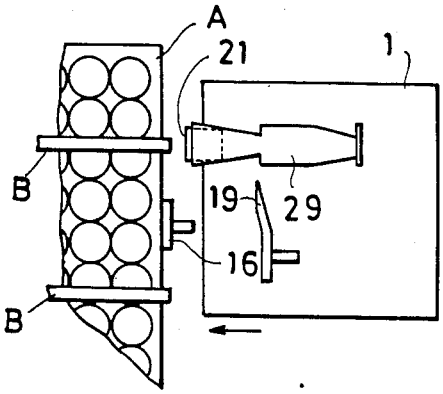
FIGS. 5(A) through 5(H) are views showing an operation sequence of the apparatus.
Figure 5B:
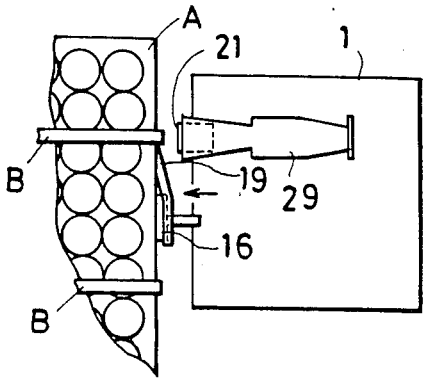
Figure 5C:
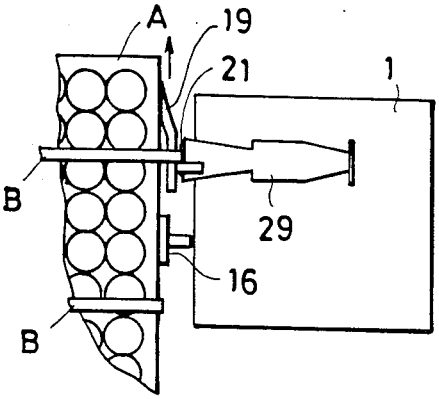
Figure 5D:
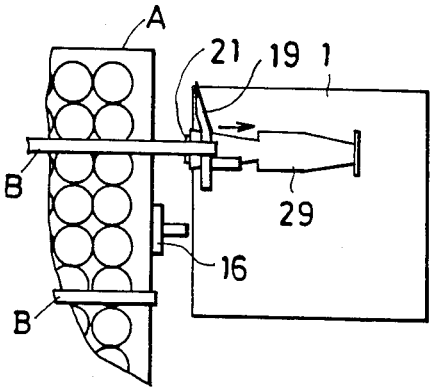
Figure 5E:
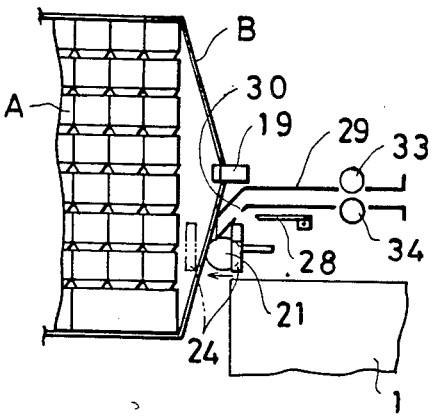
Figure 5F:
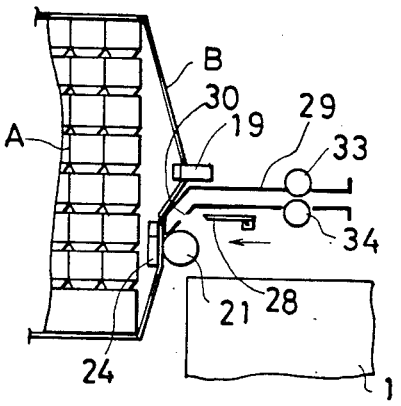
Figure 5G:
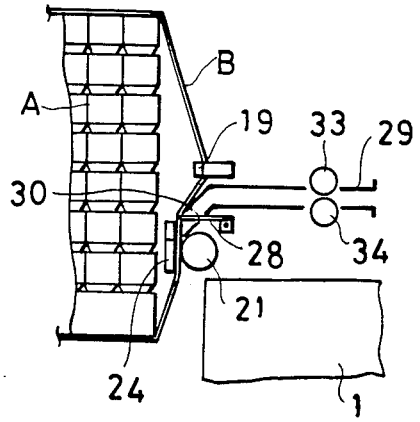
Figure 5H:
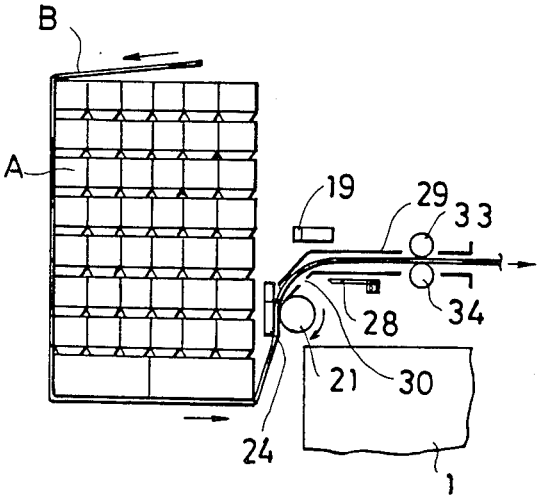

The apparatus is positioned such that the chute 29 faces one of the tying bands which is to be cut off. Then, the first slide table 4 (not shown in FIGS. 5(E) through 5(H)) is moved forward by the first longitudinal fluid cylinder 3 until the pusher 16 engages the package A, and then the first slide table 14 is stopped, as shown in FIG. 5(A). The pulling plate 19 is moved forward into engagement with the package A by the third longitudinal fluid cylinder 10, and is then stopped, as shown in FIG. 5(B). Then, the pulling plate 19 is inserted into a position behind the tying band B by forward movement of the first transverse fluid cylinder 18, as shown in FIG. 5(C). The third longitudinal fluid cylinder 10 is then operated to retract the pulling plate 19 for thereby pulling the tying band B away from the package A, leaving a space between the package A and the pulled tying band B, as shown in FIG. 5(D). Thereafter, the fourth longitudinal fluid cylinder 14 is operated to move forward the guide plate 24, and then the second transverse fluid cylinder 25 is moved forward to insert the guide plate 24 into the space behind the tying band B, as shown in FIG. 5(E). The guide roll 21 is pushed by forward movement of the second slide table 7 to press the tying band B against the guide plate 24, so that the tying band B is gripped between the guide roll 21 and the guide plate 24. At this time, the opening 32 of the chute 29 is positioned near the gripped portion of the tying band B. Then, the cutting blade 28 is moved forward by the fifth longitudinal fluid cylinder 27 to cut off the gripped tying band B, as illustrated in FIG. 5(G). Thereafter, as shown in FIG. 5(H), the guide roll 21 is rotated in a direction toward the slot 31 to feed the tying band B as it is gripped by the guide roll 21 and the guide plate 24, into the chute 29, whereupon the tying band B is discharged by the delivery rolls 33, 34 through the discharge passage 32.

Since the tying band B is cut off by the cutting blade 28 while the tying band B is spaced from the package A, there is no danger of damaging the package A at the time of severing the tying band B. The tying band B can be discharged by the guide roll 21 and the delivery rolls 33, 34 immediately after it is severed. Therefore, by positioning the apparatus alongside of a tying band to be cut off and removed from a package and operating the apparatus, the tying band can automatically be cut off and removed in consecutive steps. Accordingly, a tying band can be severed and removed efficiently from a package.

Although a certain preferred embodiment has been shown and described, it should be understood that many changes and modifications may be made therein without departing from the scope of the appended claims.

What is claimed is:

1. A method of removing an endless tying band from a package, comprising the steps of:

displacing a portion of the tying band from the package thus defining a space between said portion of the tying band and the package;

inserting a guide plate into said space;

pressing the tying band against the guide plate with a guide roll to grip the tying band between the guide plate and the guide roll;

severing the tying band which is gripped between the guide plate and the guide roll; and rotating the guide roll to deliver an end of the severed tying band which is gripped between the guide plate and the guide roll for thereby removing the severed tying band from the package.

2. An apparatus for removing an endless tying band from a package, comprising:

pulling means for inserting a pulling member between the tying band and the package to displace a portion of the tying band from the package thus defining a space between said portion of the tying band and the package;

guide plate means for inserting a guide plate into said space;

guide roll means for pressing the tying band against the guide plate with a guide roll to grip the tying band between the guide plate and the guide roll;

severing means for severing the tying band near a position in which it is gripped between the guide plate and the guide roll; and guide roll rotating means for rotating the guide roll to deliver an end of the severed tying band.

3. An apparatus according to claim 2, wherein said pulling member includes a plate insertable between the tying band and the package, a first moving device for moving said pulling member toward and away from a position engaging the package, and a second moving device for moving said pulling member along an outer surface of the package.

4. An apparatus according to claim 2, wherein said guide plate means comprises a third moving device for moving said guide plate toward an outer surface of the package, and a fourth moving device for moving said guide plate toward said space defined between the portion of the tying band displaced by the pulling means and the outer surface of the package.

5. An apparatus according to claim 2, wherein said guide roll means comprises a fifth moving device for moving said guide roll to a position in which said guide roll presses the tying band against said guide plate.

6. An apparatus according to claim 2, wherein said severing means comprises a cutter blade and a sixth moving device for moving said cutter blade closely to said position.

7. An apparatus according to claim 2, wherein said severing means comprises a chute having a slot opening toward a position in which the tying band is severed, so that the severed tying band will be discharged through said chute.

8. An apparatus according to claim 7, wherein said guide roll rotating means rotates said guide roll in a direction toward said slot of the chute.

9. An apparatus according to claim 2, wherein said guide roll rotating means rotates said guide roll after the tying band has been gripped between said guide plate and said guide roll.

* * * * *